US011857042B2

(12) United States Patent
Ganino

(10) Patent No.: US 11,857,042 B2
(45) Date of Patent: Jan. 2, 2024

(54) SATCHEL AND WALLET COMBINATION ASSEMBLY

(71) Applicant: James Ganino, Plymouth, MN (US)

(72) Inventor: James Ganino, Plymouth, MN (US)

( * ) Notice: Subject to any disclaimer, the term of this patent is extended or adjusted under 35 U.S.C. 154(b) by 91 days.

(21) Appl. No.: 17/518,945

(22) Filed: Nov. 4, 2021

(65) Prior Publication Data

US 2022/0053897 A1 Feb. 24, 2022

Related U.S. Application Data

(63) Continuation-in-part of application No. 16/178,160, filed on Nov. 1, 2018, now Pat. No. 11,172,740.

(51) Int. Cl.

| | |
|---|---|
| ***A45C 1/06*** | (2006.01) |
| ***A45C 1/08*** | (2006.01) |
| ***A45C 7/00*** | (2006.01) |

(52) U.S. Cl.

CPC ..... *A45C 1/06* (2013.01); *A45C 1/08* (2013.01); *A45C 7/0077* (2013.01); *A45C 2001/065* (2013.01); *A45C 2007/0004* (2013.01)

(58) Field of Classification Search

CPC ..... A45C 1/06; A45C 1/08; A45C 7/0077; A45C 2001/065; A45C 2007/0004

See application file for complete search history.

(56) References Cited

U.S. PATENT DOCUMENTS

| | | | | |
|---|---|---|---|---|
| 1,606,107 | A * | 11/1926 | Simms | A45C 7/0063 383/4 |
| 3,256,919 | A | 6/1966 | Olgetree | |
| 4,117,874 | A | 10/1978 | Berenguer | |
| 4,126,168 | A * | 11/1978 | Ganz | A45C 1/08 206/38.1 |
| 4,921,027 | A | 5/1990 | Scheunemann | |
| 5,423,363 | A | 6/1995 | Matzdorff | |
| 5,454,643 | A | 10/1995 | Sullivan | |
| 5,490,619 | A | 2/1996 | Boyar | |
| 7,607,463 | B2 * | 10/2009 | Huber | A45C 1/06 206/214 |
| 2006/0013513 | A1 | 1/2006 | Meyer | |
| 2006/0151077 | A1 * | 7/2006 | Milford | A45C 1/06 150/147 |
| 2007/0138222 | A1 | 6/2007 | Goldman | |
| 2007/0241018 | A1 * | 10/2007 | Forte | A45C 1/06 150/112 |
| 2009/0288746 | A1 * | 11/2009 | Baca | A45C 1/06 150/145 |
| 2012/0121211 | A1 | 5/2012 | Kovatch | |

* cited by examiner

*Primary Examiner* — Tri M Mai

(57) ABSTRACT

A satchel and wallet combination assembly includes a container that is flexible and includes a perimeter wall having an upper end open to access an interior of the container. The container may be manipulated into a folded condition wherein the container is folded multiple times upon itself and into a deployed condition wherein the container is unfolded. A wallet is attached to a front wall of the container such that a top edge of the wallet is positioned adjacent to the upper end and the first lateral edge of the container. The wallet is positionable in the container when the container is in the deployed condition. The container is abuttable against the wallet when the container is in the folded condition such that the container has a length and width substantially equal to a length and width of the wallet.

6 Claims, 15 Drawing Sheets

SATCHEL AND WALLET COMBINATION ASSEMBLY

CROSS-REFERENCE TO RELATED APPLICATIONS

This application is a continuation in part and takes the benefit of non-provisional U.S. application Ser. No. 16/178,160 filed on Nov. 11, 2018.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bag and auxiliary compartment combination devices and more particularly pertains to a new bag and auxiliary compartment combination device for that allows a person to carry a wallet which may be unfolded to form a flexible bag for carrying articles such as groceries and the like. As concerns for the environment grow, many municipalities are passing ordinances that restrict stores and grocers from supplying plastic bags to their patrons. However, patrons often forget their dedicated grocery bags at home or simply do not have the bags when it is convenient to shop. The current device overcomes this inconvenience by ensuring that a user thereof will always have a bag available should one be needed by allowing the conversion of their wallet into a bag.

BRIEF SUMMARY OF THE INVENTION

An embodiment of the disclosure meets the needs presented above by generally comprising a container that is flexible and includes a perimeter wall having an upper end open to access an interior of the container. The container may be manipulated into a folded condition wherein the container is folded multiple times upon itself and into a deployed condition wherein the container is unfolded. A wallet is attached to a front wall of the container such that a top edge of the wallet is positioned adjacent to the upper end and the first lateral edge of the container. The wallet is positionable in the container when the container is in the deployed condition. The container is abuttable against the wallet when the container is in the folded condition such that the container has a length and width substantially equal to a length and width of the wallet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
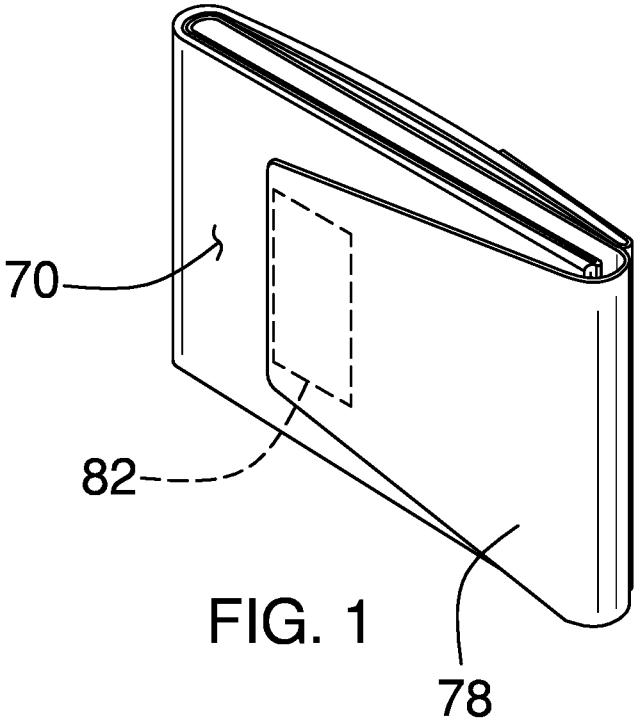
FIG. 1 is a front isometric view of a satchel and wallet combination assembly according to an embodiment of the disclosure.
Figure 2:
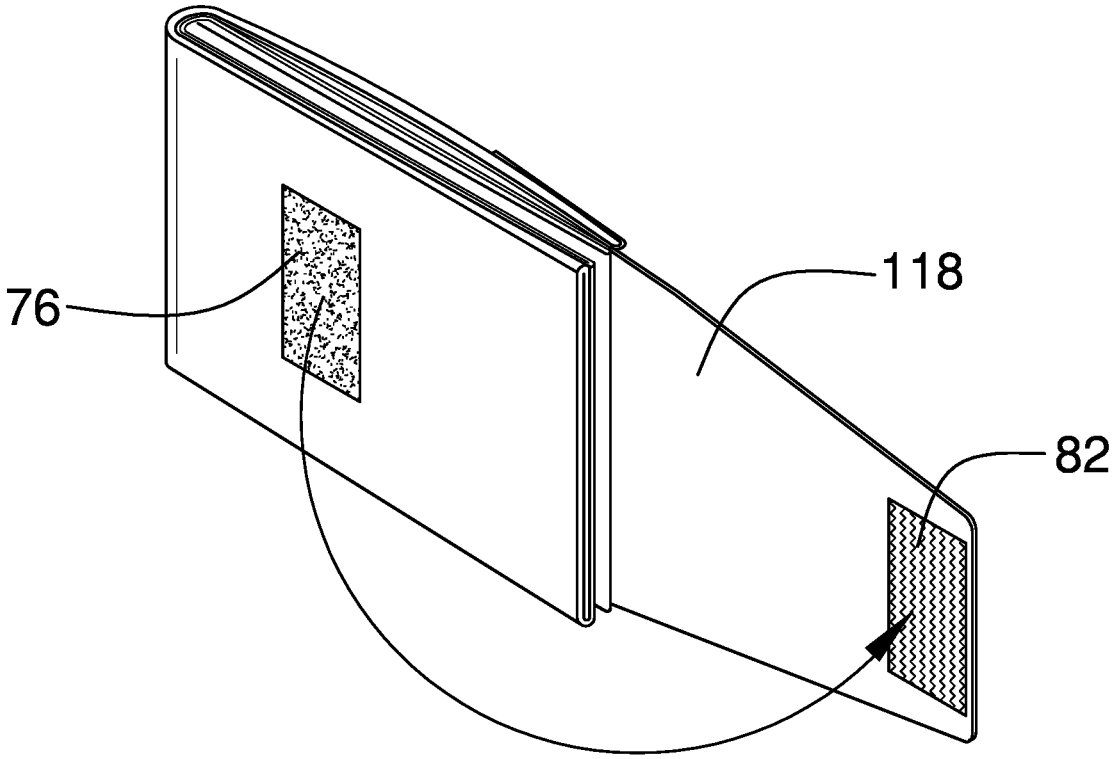
FIG. 2 is a front isometric view of an embodiment of the disclosure.

With reference now to the drawings, and in particular to FIGS. 1 through 17 thereof, a new bag and auxiliary compartment combination device embodying the principles and concepts of an embodiment of the disclosure and generally designated by the reference numeral 10 will be described.

As best illustrated in FIGS. 1 through 9, the satchel and wallet combination assembly 10 generally comprises a container 12 that is flexible and includes a perimeter wall 14 having an upper end 16 that is open to access an interior of the container 12. The material used for forming the container 12 ensures that the container 12 is configured to be manipulated into a folded condition wherein the container is folded multiple times upon itself and may then be manipulated into a deployed condition wherein the container 12 is unfolded. The material may include a woven cloth material that may, in particular, be comprised of a synthetic cloth such as woven plastic to provide a high strength to thread diameter ratio. Generally, the perimeter wall will have a thickness of less than 1.0 mm and be sufficiently flexible to allow for easy folding thereof.

The perimeter wall 14 includes a first lateral edge 18, a second lateral edge 20 and a bottom edge 22. The perimeter wall 14 has a front wall 24 and a rear wall 26 wherein the front 24 and rear 26 walls are joined together along the first lateral edge 18, the second lateral edge 20 and the bottom edge 22. The front 24 and rear 26 walls will each likely have a substantially rectangular shape, though the junctures of the bottom edge 22 with the first 18 and second 20 lateral edges may be angled. The first lateral 18, second lateral 20 and bottom edges 22 and the upper end 16 each have a length of between 12.0 inches and 20.0 inches, though the upper end 16 will typically be between 14.0 inches and 18.0 inches in length.

The container 12 is foldable along multiple horizontal fold lines 28 extending from the first lateral edge 18 to the second lateral edge 20 to define horizontal sections 30 of the perimeter wall 14 each having a same height. Though the height of each horizontal section 30 may vary, each horizontal section 30 will typically have a height between 3.0 inches and 4.0 inches and will number at least three horizontal sections 30. The container 12 is also foldable along a vertical fold line 32 extending from the upper end 16 to the bottom edge 22 to define vertical sections each having a same width. Additional vertical fold lines 32 may be utilized, but a single vertical fold like will generally suffice for the purposes herein. The container 12 is foldable along each of the vertical 32 and horizontal 28 fold lines to define a folded edge 34 and a pair of free ends 36 positioned opposite of the folded edge.

A strap 38 is attached to the container 12 adjacent to the upper end 16. The strap 38 has attached ends 40 that may be positioned, and attached, within the container 12. The strap 38 is comprised of a material that is flexible and may include the same material used to construct the container 12. The strap 38 is relatively thin, easily bendable and is positioned usually within the container 12 when the container 12 is in the folded condition.

Figure 5:
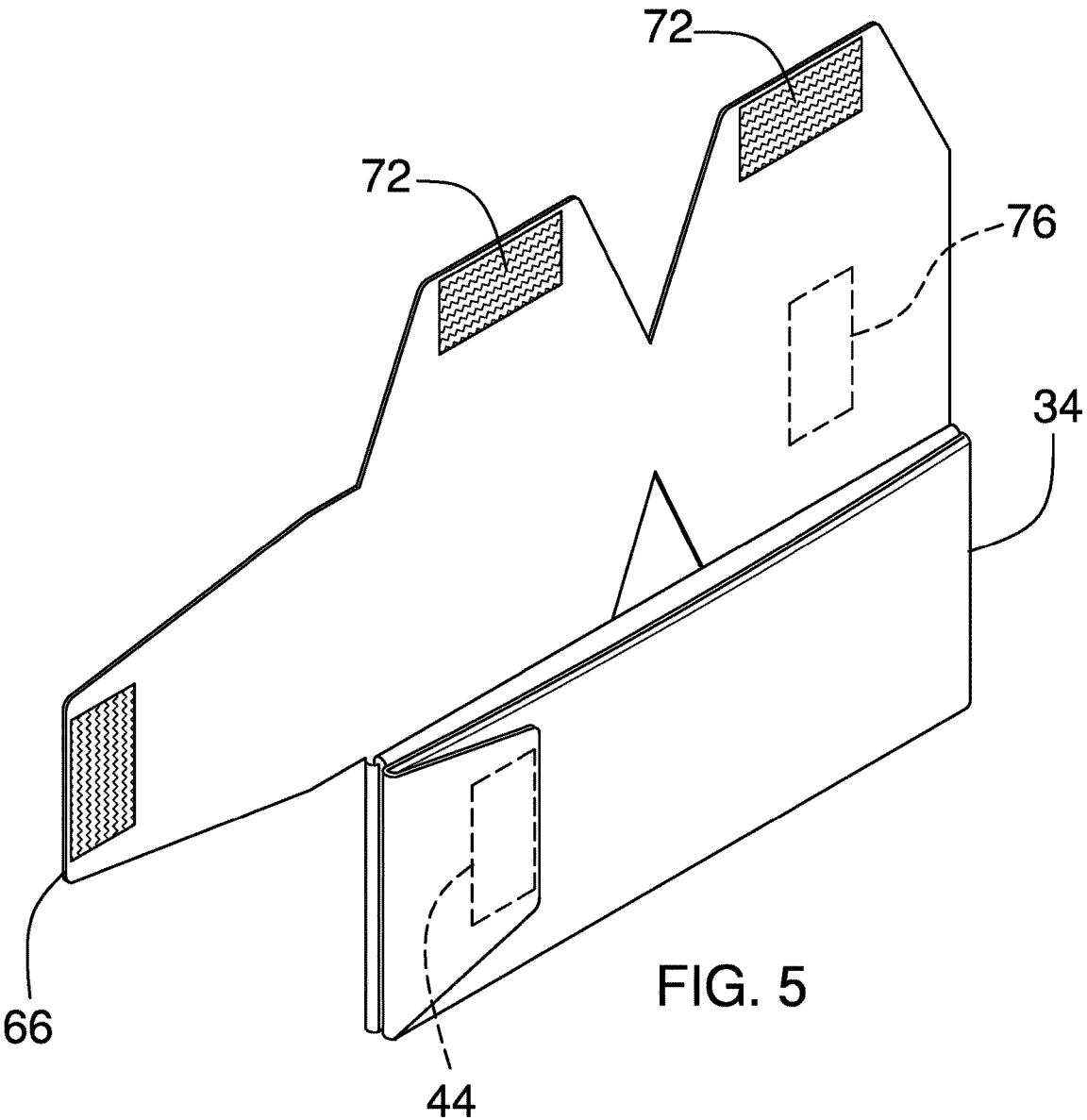
FIG. 5 is a rear isometric view of an embodiment of the disclosure.
Figure 6:
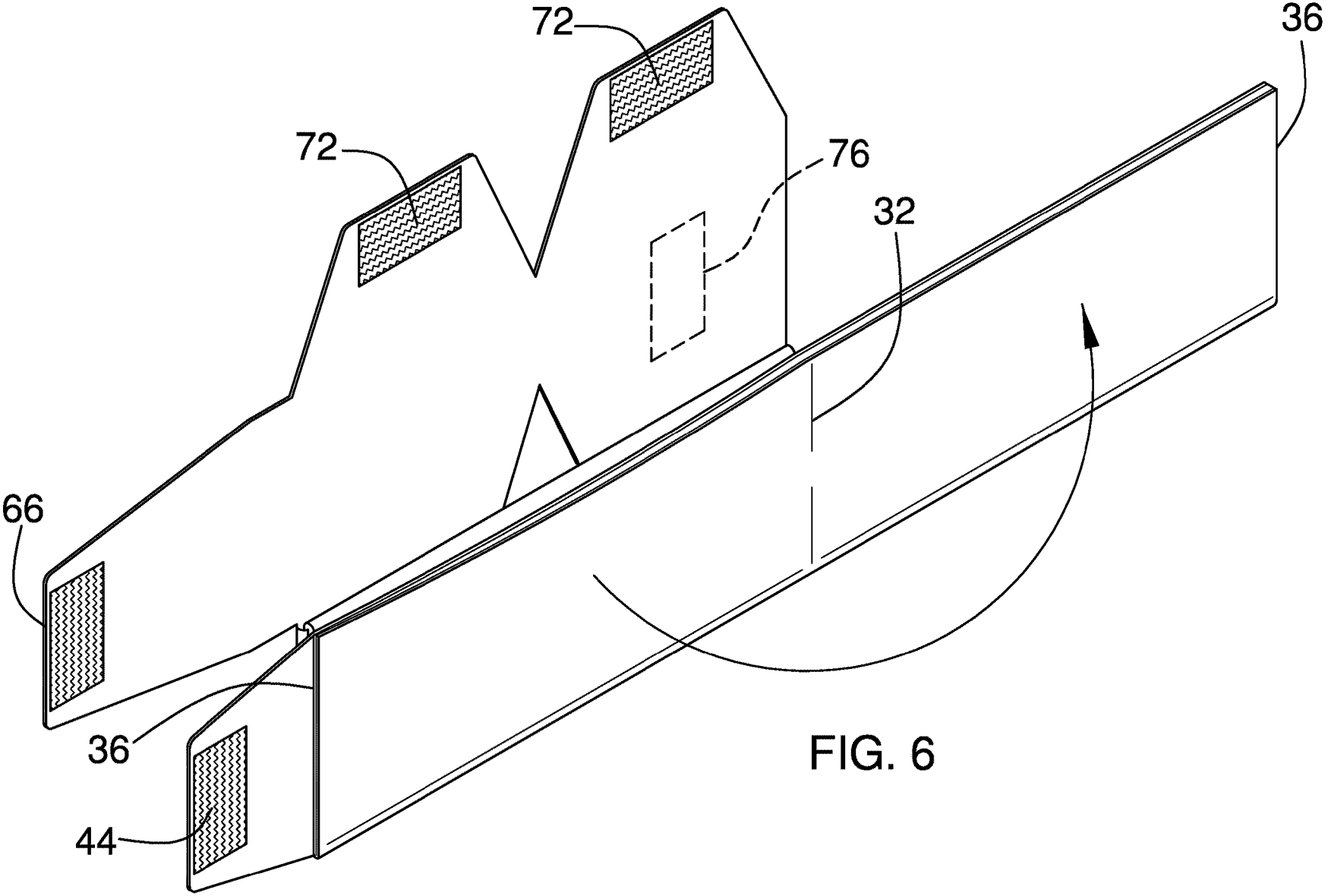
FIG. 6 is a rear isometric view of an embodiment of the disclosure showing another step in deploying the container thereof.

A flap 42 is attached to the first lateral edge 18 adjacent to the upper end 16. The flap 42 is extendable over the free ends 36 and is releasably secured to an outer surface of the front wall 24 to retain the free ends 36 adjacent to each other and retain the container 12 in the folded condition as shown in FIG. 5. A first mating member 44 on the flap 42 is releasably engageable with a second mating member 46 on the front wall 24. For the purpose of this invention, multiple pairs of first and second mating members are utilized and will typically include any conventional fastening means but specifically may include hook and look couplers, male and female snap members, and magnetic mating couplers including a pair of magnets or a magnet and a material magnetically attracted to the magnet.

Figure 9:
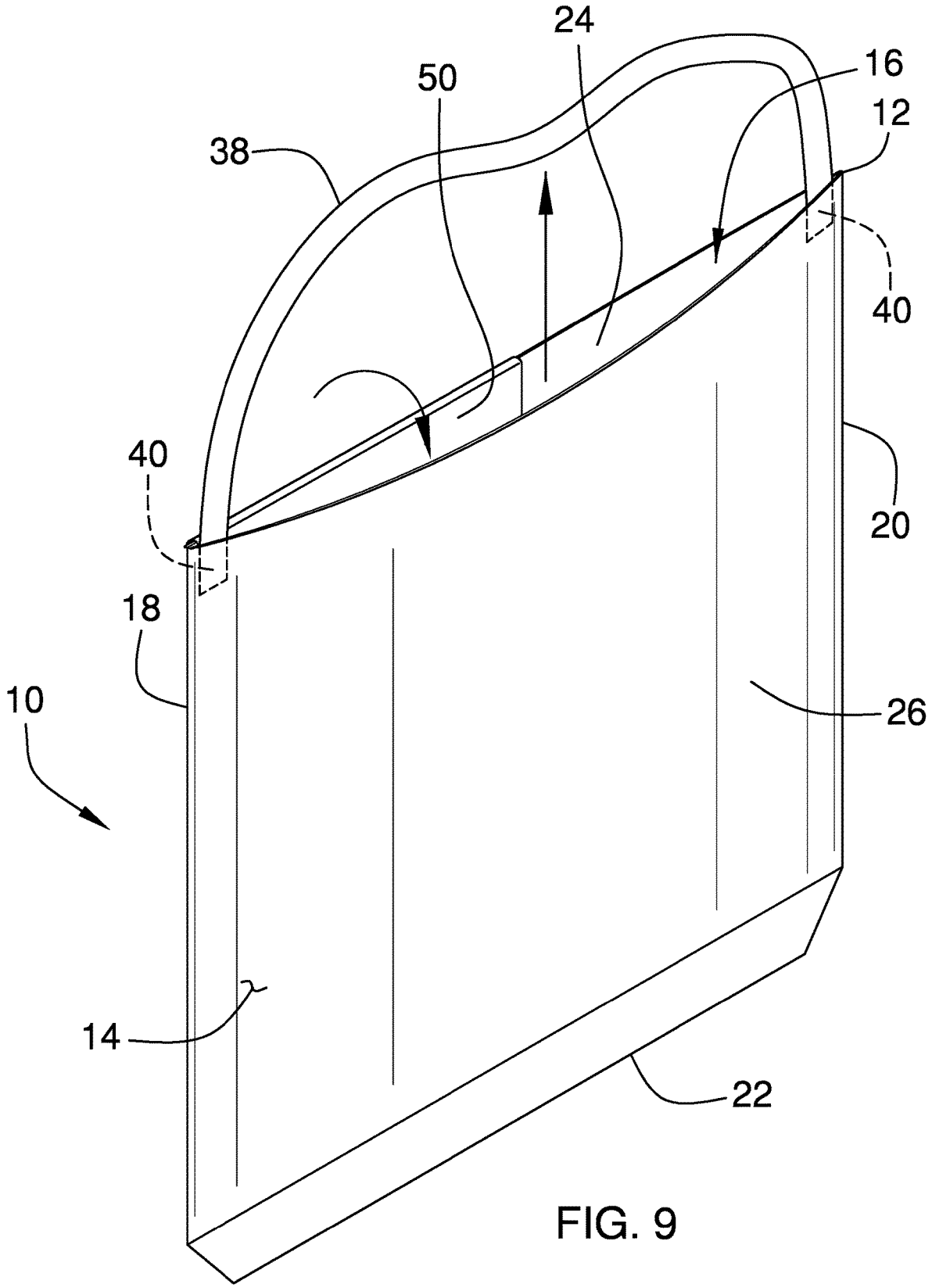
FIG. 9 is a rear isometric view of an embodiment of the disclosure showing the wallet positioned within the container.
Figure 10:
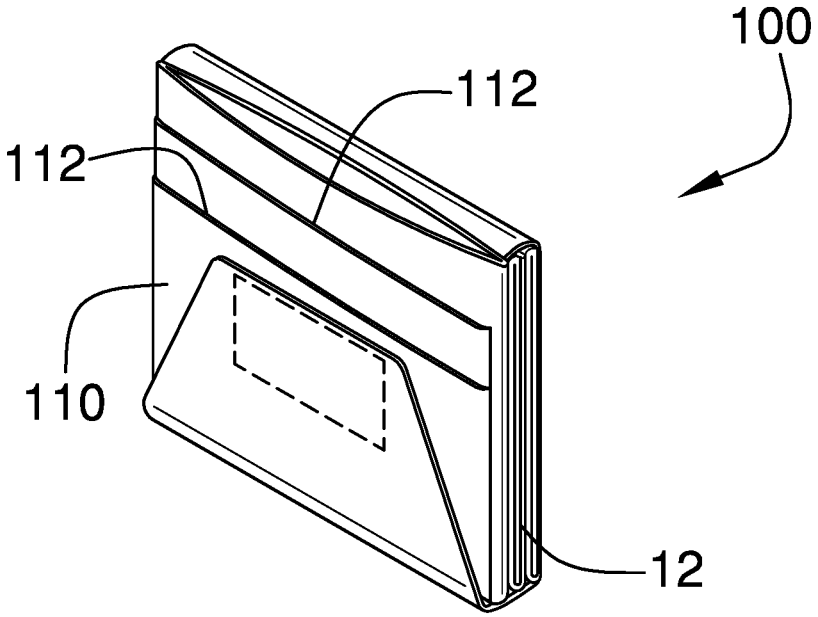
FIG. 10 is a front isometric view of another embodiment of the disclosure.
Figure 11:
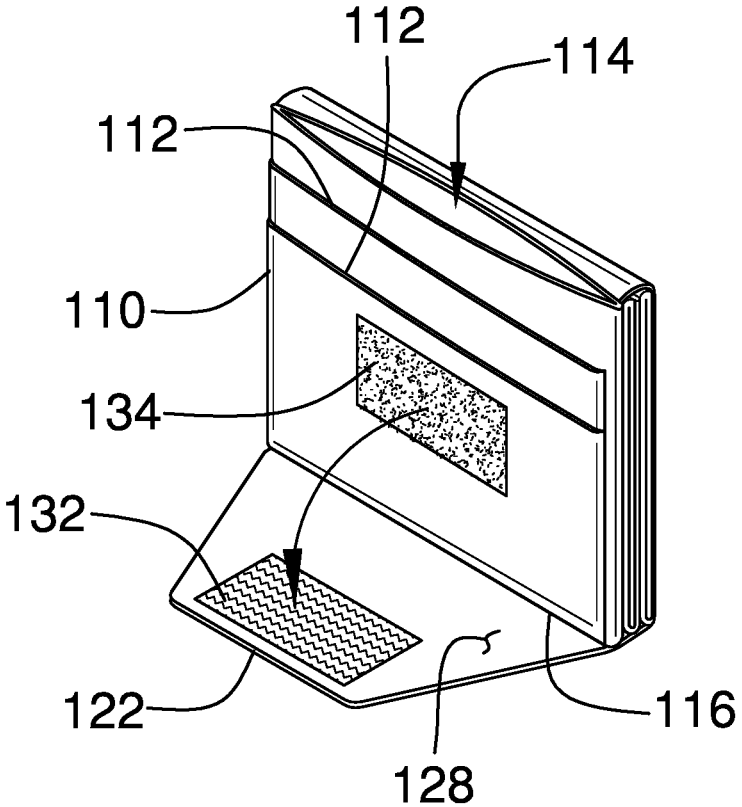
FIG. 11 is a front isometric view of the embodiment shown in FIG. 10 of the disclosure depicting a wallet thereof.
Figure 12:
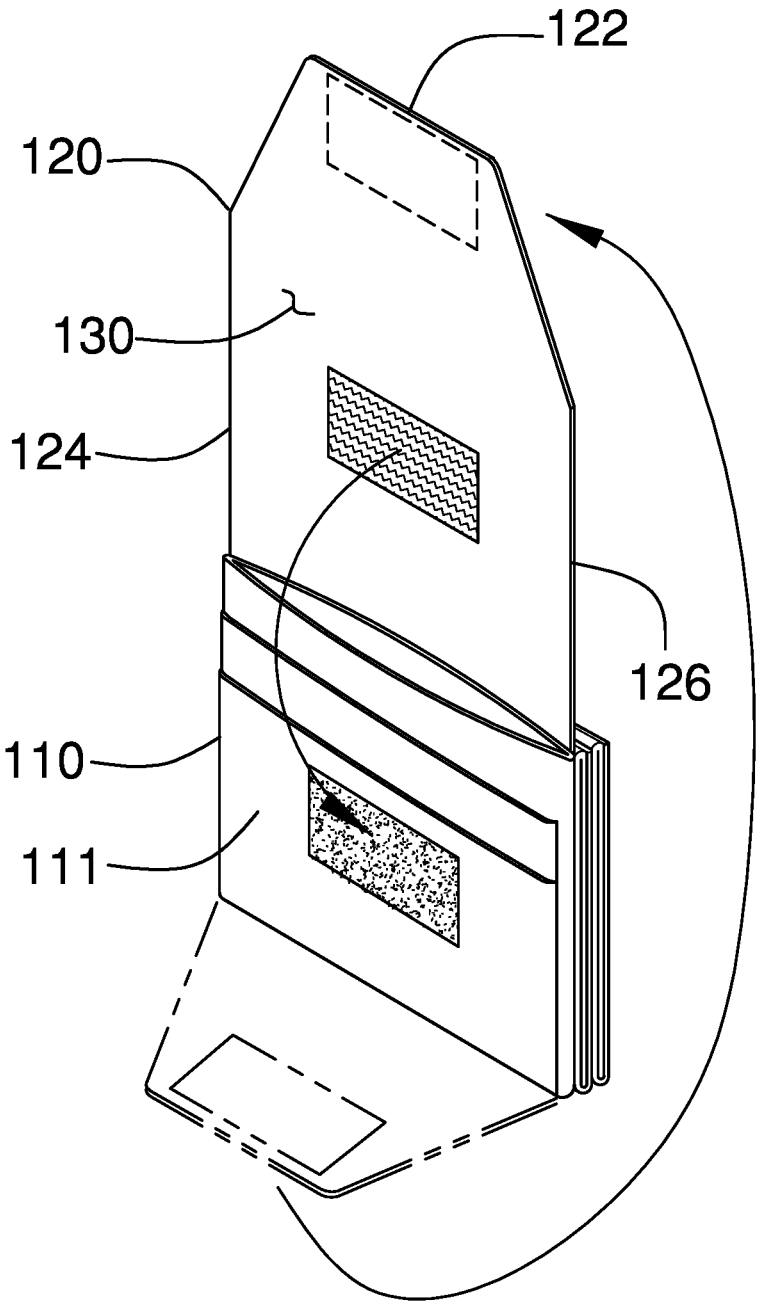
FIG. 12 is a front isometric view of the embodiment in FIG. 10 of the disclosure showing a step in deploying a container thereof.
Figure 13:
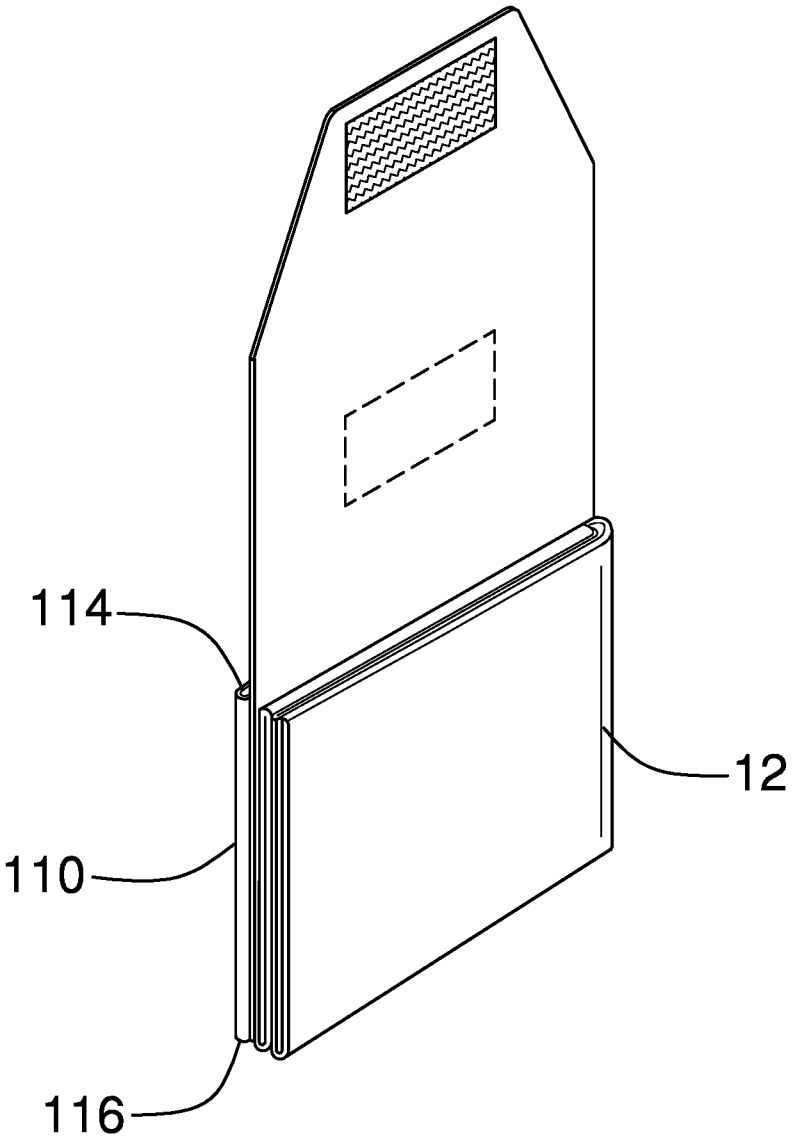
FIG. 13 is a rear isometric view of the embodiment of the disclosure as shown in FIG. 12.
Figure 14:
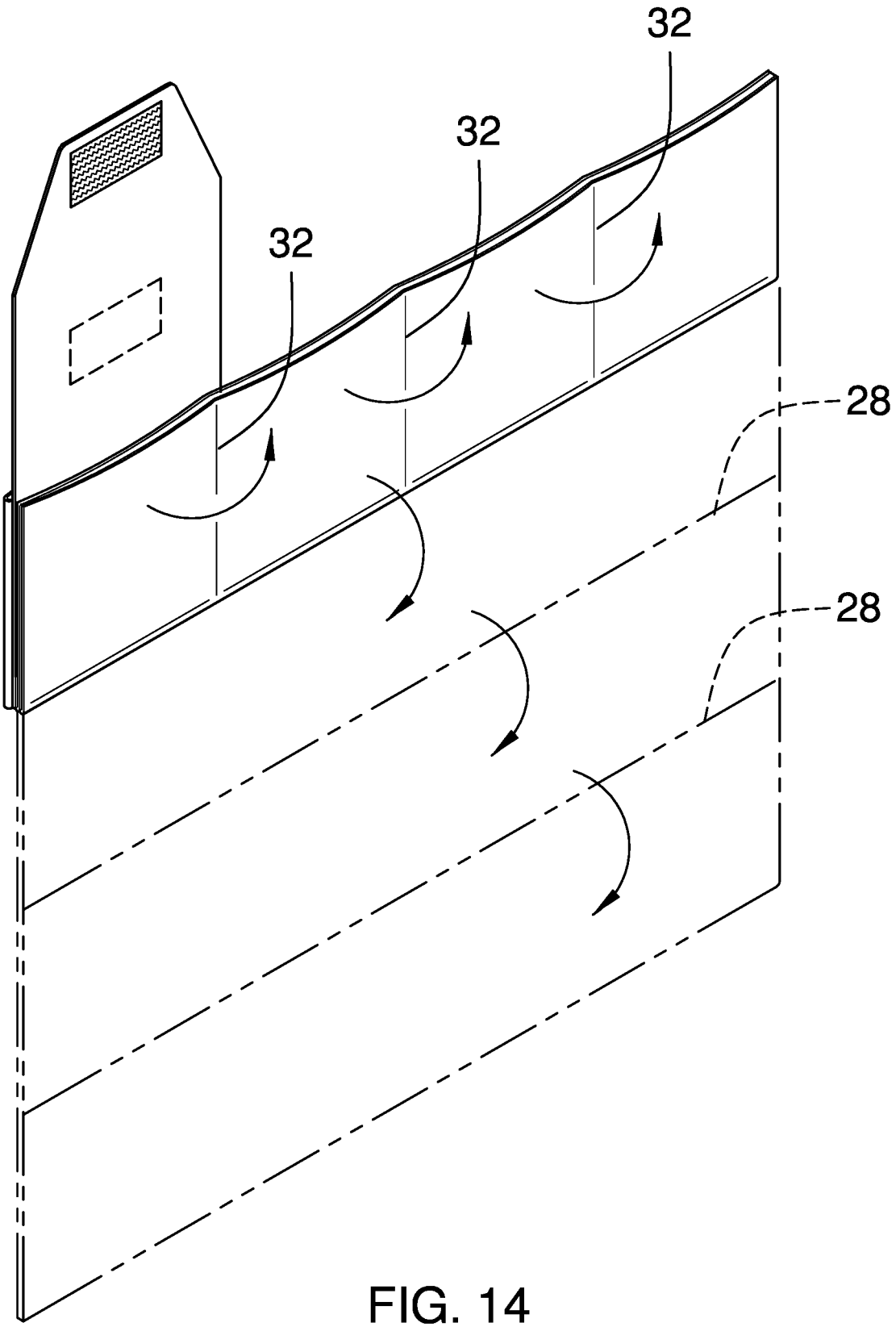
FIG. 14 is a rear isometric view of the embodiment in FIG. 10 of the disclosure showing another step in deploying the container thereof.
Figure 15:
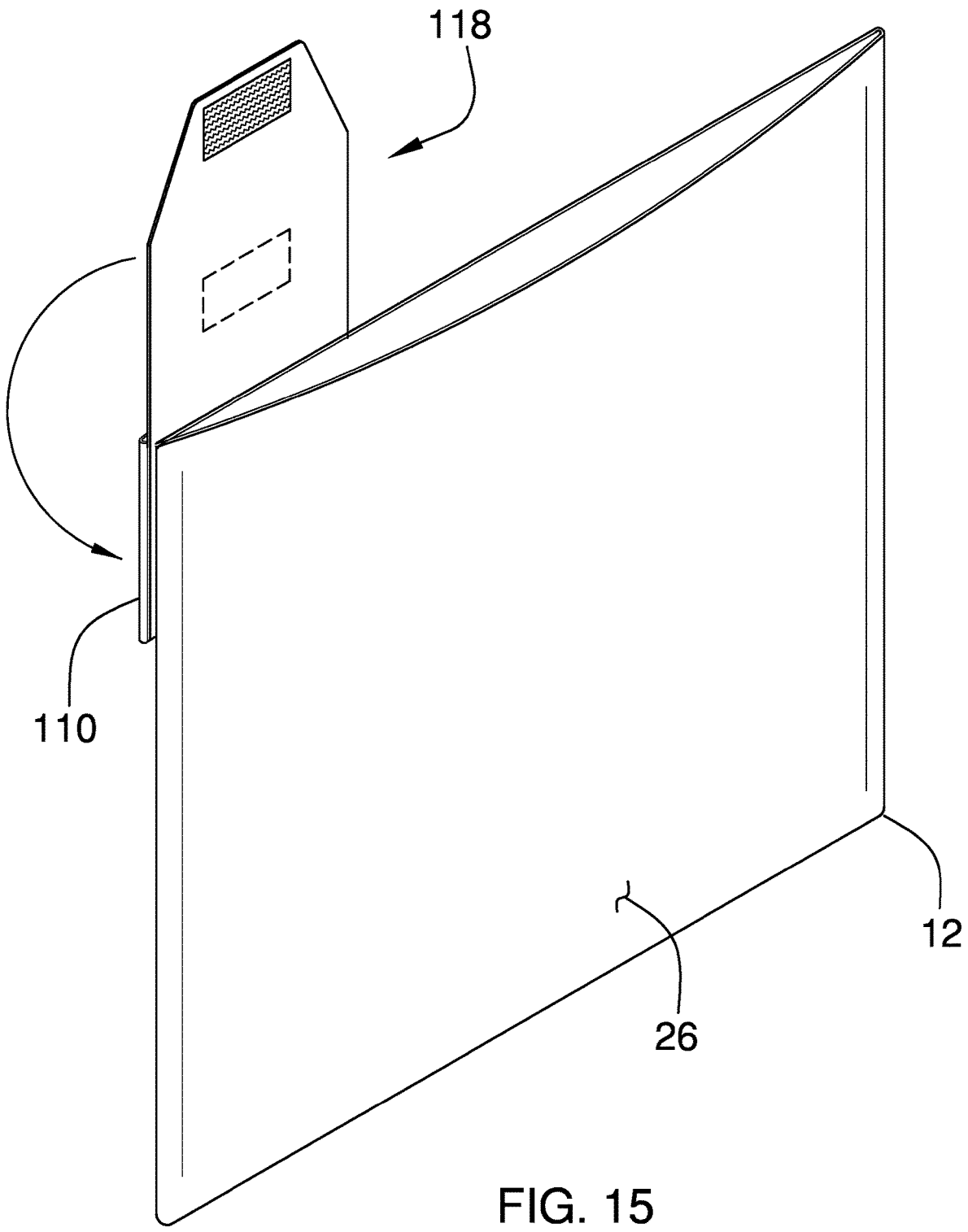
FIG. 15 is a rear isometric view of the embodiment in FIG. 10 of the disclosure showing the container being nearly fully deployed.
Figure 16:
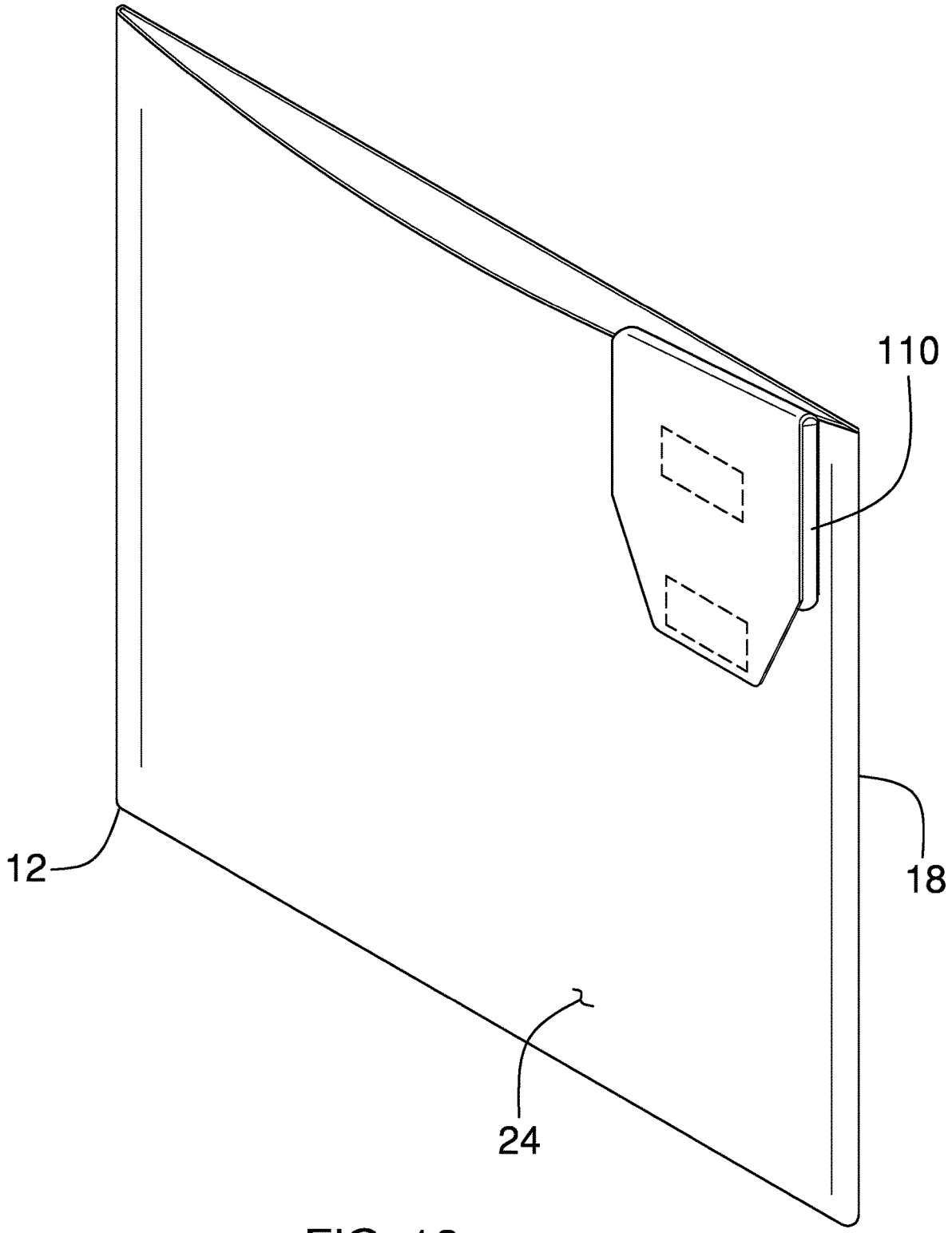
FIG. 16 is a front isometric view of the embodiment of the disclosure in FIG. 10.

A wallet 50 is attached to the front wall 24 of the container 12 such that a top edge 52 of the wallet 50 is positioned adjacent to the upper end 16 and the first lateral edge 18 of the container 12. The wallet 50 may be attached by a strip of material similar to that being used for the container 12 or may directly attached to the container 12 along the top edge 52 and upper end 16. The wallet 50 may extend from the first lateral edge 18 to the vertical folding line 32 or approximately half the distance from the first lateral edge 18 to the second lateral edge 20. A top end 54 of the wallet 50 comprises an elongated opening configured to receive paper money. The wallet 50 has an inner wall 56 facing away from the container 12 when the container 12 is in the deployed condition. The inner wall 56 has a plurality of card pockets 58 mounted thereon. Each of the card pockets 58 has an upwardly directed opening 60 and are used for holding cards such as identification cards, credit cards, bank cards, business cards and the like. The card pockets 58 may include a first set of the card pockets and a second set of the card pockets wherein the first set is laterally disposed with respect to the second set. The wallet 50 is foldable in half along a line separating the first and second sets of card pockets 58. As can be seen in FIG. 9, the wallet 50 is positionable in the container 12 when the container 12 is in the deployed condition. It should be further understood that when the wallet 50 is flipped over from an outer surface of the front wall 24 to an inner surface of the front wall 24, the wallet 50 remains in an upright position. That is, its top end 54 is still pointing upwardly and therefore any money positioned therein will not fall outwardly of the wallet 50 as the container is being used for carrying various articles.

Figure 3:
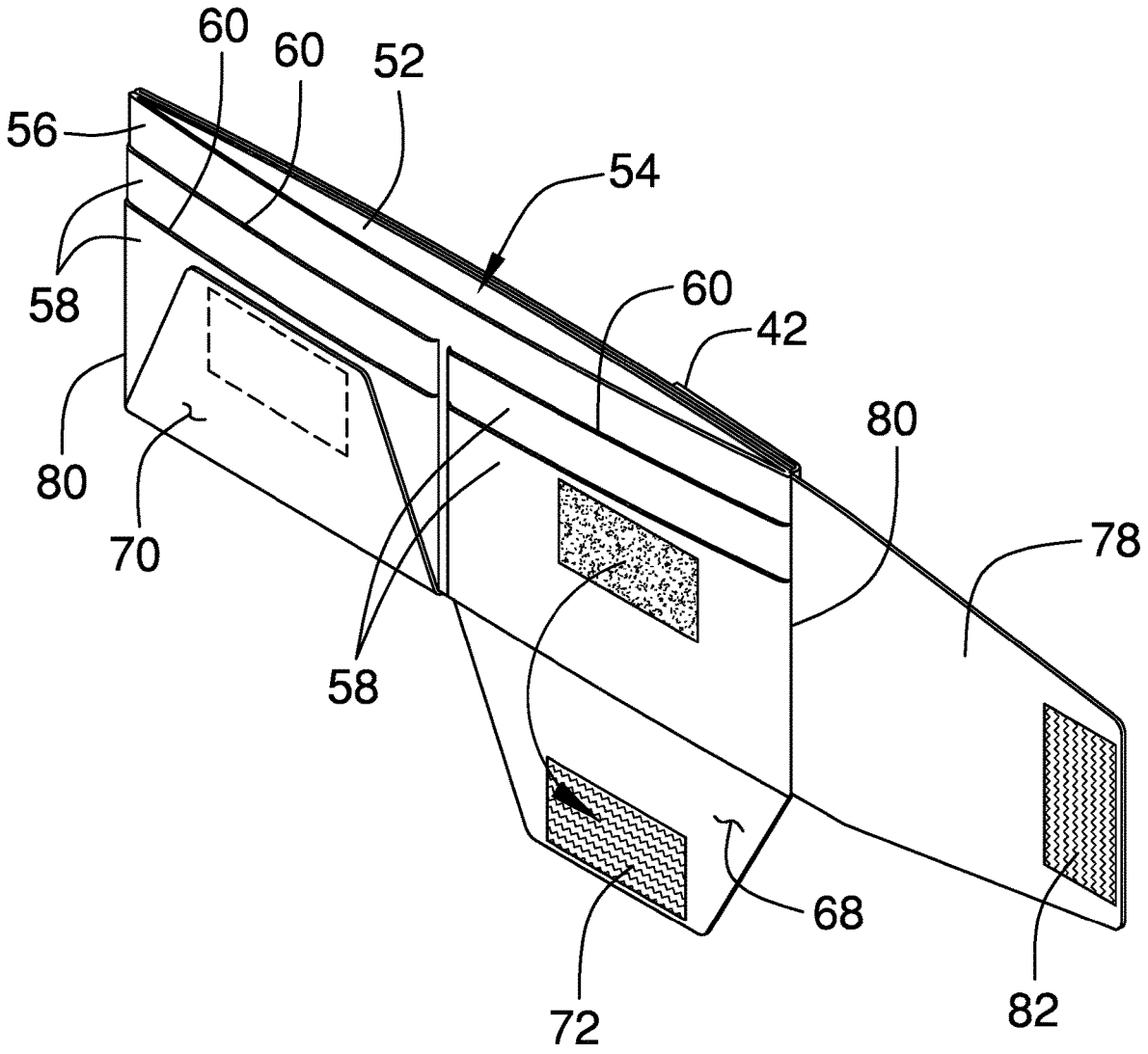
FIG. 3 is a front isometric view of an embodiment of the disclosure depicting a wallet thereof.
Figure 4:
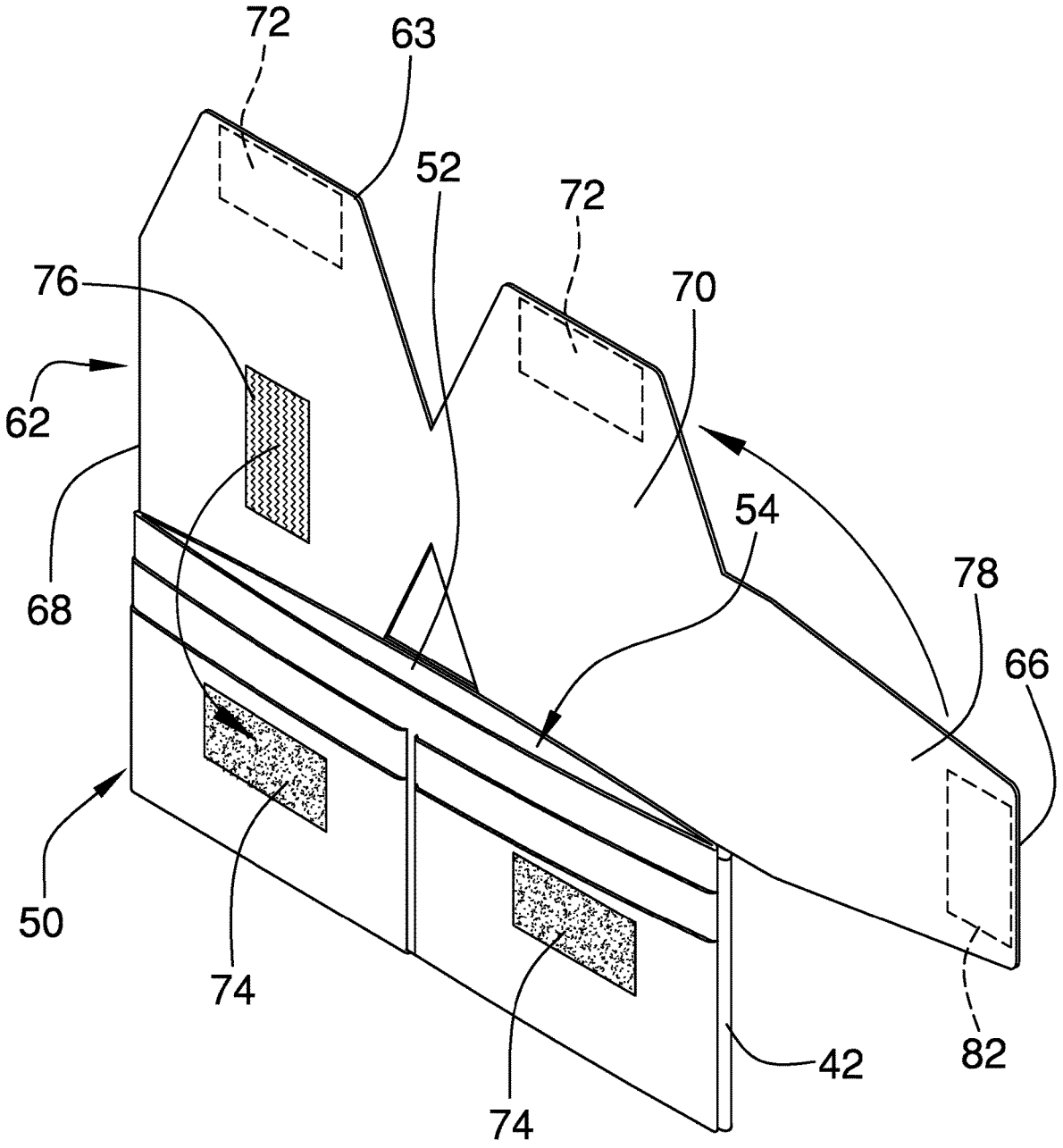
FIG. 4 is a front isometric view of an embodiment of the disclosure showing a step in deploying a container thereof.
Figure 7:
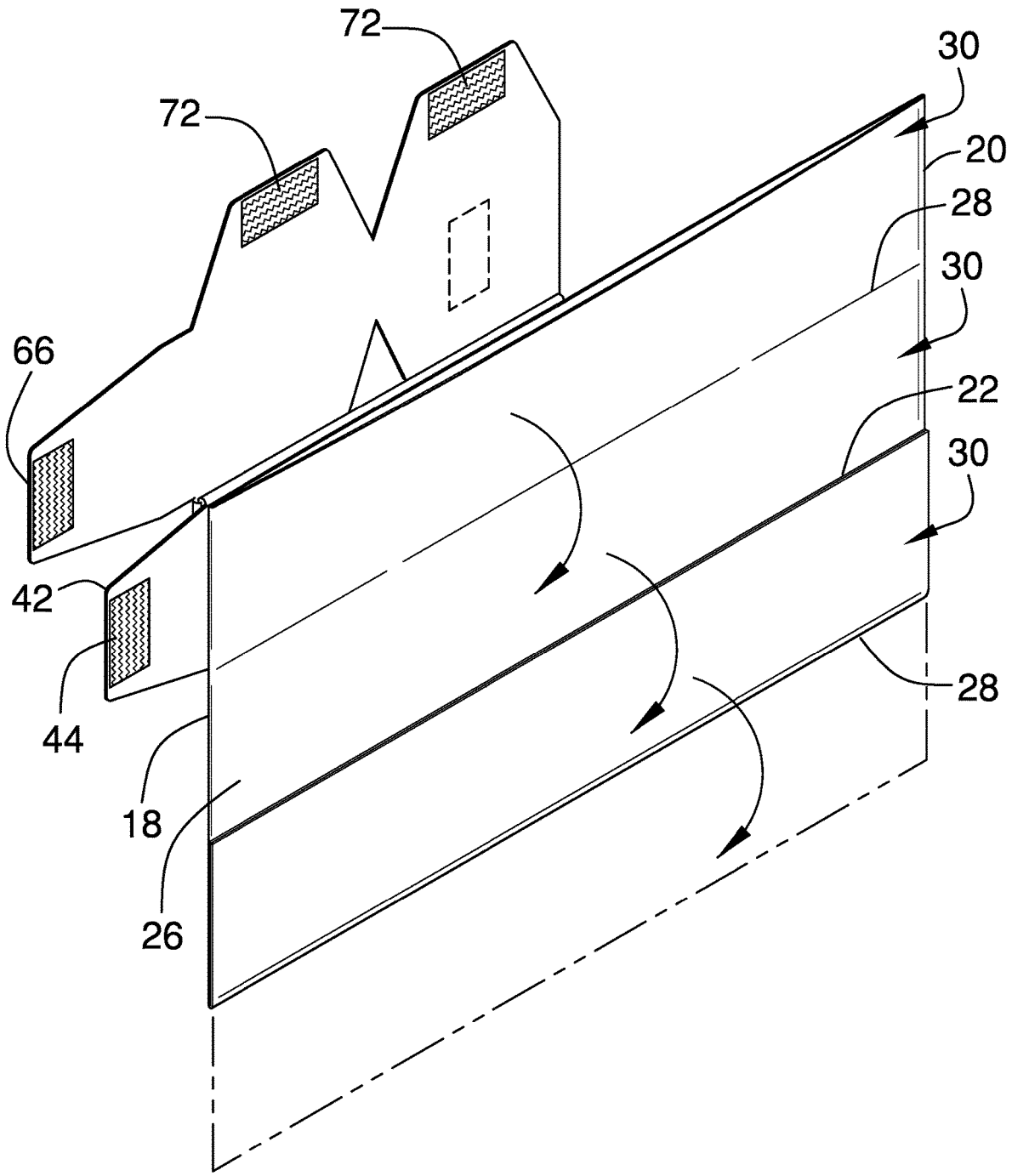
FIG. 7 is a rear isometric view of an embodiment of the disclosure showing the container being nearly fully deployed.
Figure 8:
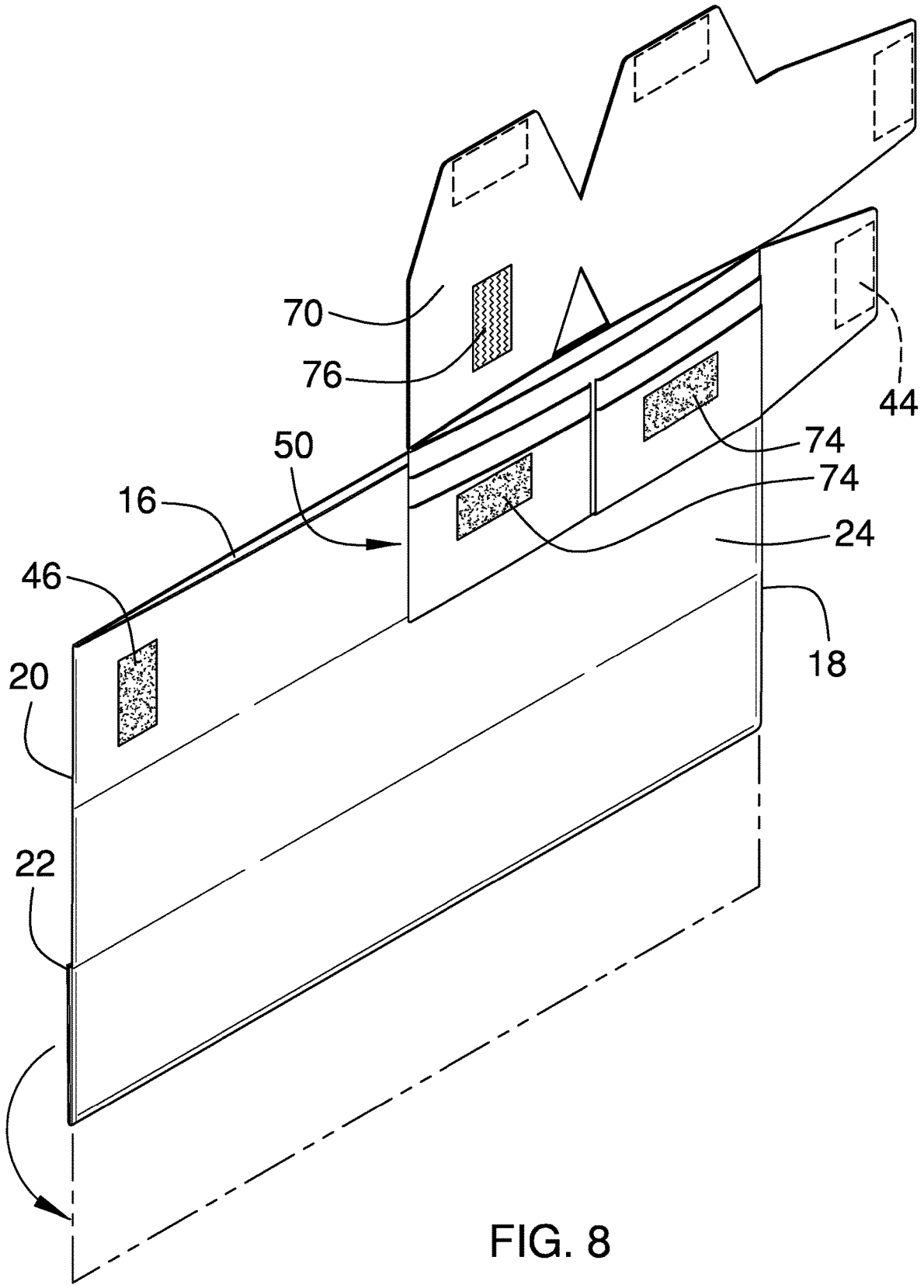
FIG. 8 is a front isometric view of an embodiment of the disclosure as shown in FIG. 7.

A panel 62 is attached to and extends upwardly from a juncture of the wallet 50 and the container 12. The panel 62 has a distal edge 63 with respect to the wallet 50. The panel 62 has a first side edge 64, a second edge 66, an inner surface 68 and an outer surface 70. The inner surface 68 of the panel 62 is extendable rearwardly away from the wallet 50, over the container 12, and abutted against the inner wall 56 as is shown in FIG. 3. The panel 62 may include a pair of sections that are separated from each other when engaged with the inner wall 62 to facilitate continued folding of the wallet 50. As can be seen in FIGS. 3, 4 and 7, first mating members 72 are attached to the inner surface 68 adjacent distal to the wallet 50 and are engageable with second mating members 74 on the inner wall 56 of the wallet 50 in such a manner that the card pockets 58 and top end 54 of the wallet 50 are accessible as shown specifically in FIG. 3. The panel 62 is removably attached to the inner wall 56 of the wallet 50 when the container 12 is in the folded condition to retain the container 12 in the folded condition and in abutment with the wallet 50 as a compressed configuration.

A first mating member 76 may also be positioned on outer surface 70 of the panel 62 which is engageable with one of the second mating members 74 on the wallet 50 to hold the panel 62 over the top end 54 of the wallet 50 and over the card pockets 58 to prevent items therein from falling out as the wallet 50 is moved from an exposed position outside the container 12 to a stored position within the container 12.

The first side edge 66 of the panel 62 extends laterally outwardly from the panel 62 to define an extension 78. The extension 78 is extendable over opposite edges 80 of the wallet 50 when the wallet 50 is folded and secured to the outer surface 70 of the panel 62 to retain the wallet 50 in a closed condition. This may be accomplished by using a second mating member 82 on the extension 78 which is engageable with the first mating 76 member on the outer surface 70 of the panel 62.

In the embodiment shown in FIGS. 1-9, the assembly 10 is used a conventional wallet for holding identification, bank cards and paper currency, however, if the user requires a satchel, the container 12 may be unfolded from the wallet 50 and the wallet 50 placed within the container 12. This allows the container 12 to be used in a conventional manner while also protecting the wallet 50 within the container 12.

A second embodiment 100 of the general assembly 10 is found in FIGS. 10-17 and replaces the wallet 50 for a card holder 110. The second embodiment 100 includes, essentially, a same type of a container 12 that is flexible and configured to be manipulated into a folded condition wherein the container 12 is folded multiple times upon itself and into a deployed condition wherein the container 12 is unfolded. The container 12 of the second embodiment 100 may further include a strap 38. However, as can be seen in the Figures, the container 12 of the second embodiment 100 provides for an additional vertical fold such that the container 12 forms a smaller width and therefore folds against what would be the size of a more conventional card holder.

Figure 17:
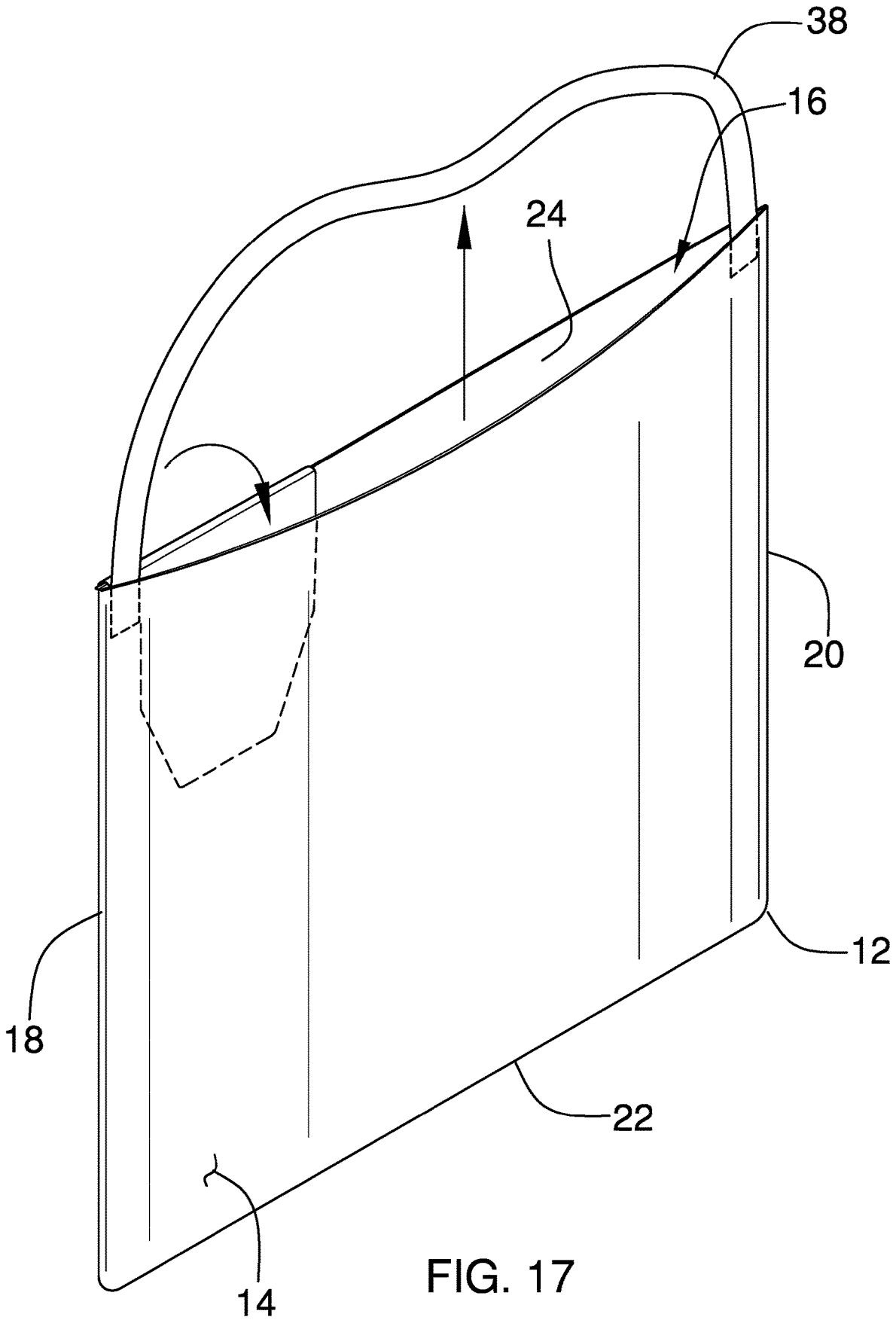
FIG. 17 is a rear isometric view of the embodiment in FIG. 10 of the disclosure showing a card holder positioned within the container.

The card holder 110 is attached to the front wall 24 of the container 12 such that an upper edge the card holder 110 is positioned adjacent to the upper end 16 and the first lateral edge 18 of the container 12. As with the wallet 50, the card holder 110 is positionable in the container 12 when the container 12 is in the deployed condition as shown in FIG. 17. The card holder 110 has a front side 111 including plurality of card pockets 112 each having a size configured to receive a credit card. A typical credit card has a measurement of 3.37 inches in width and a length of 2.125 inches, with a generally negligible thickness that is less than 0.1 inches. Thus, the card pockets 112 each have a size to accommodate these measurements.

The card holder 110 itself will have a width measurement, taken along its upper edge 114, being less than 4.0 inches and a length measured from its upper edge 114 to a lower edge 116 being less than 3.5 inches. The container 12 is abuttable against the card holder 110 when the container 12 is in the folded condition such that the container 12 has a length and width substantially equal to the length and width of the container 12. The upper edge 114 of the card holder 110 may be formed into an opening, extending into a pocket of the card holder 110, for receiving additional cards, including for example credit cards and identification cards, or can be used for other articles including paper money, receipts, a key or the like.

A closure 118 releasably retains the container 12 in the folded condition and in abutment with the card holder 110 such that at least one of the card pockets 112 is exposed. The closure 118 will also typically leave exposed the opening in the upper edge 114. The closure 118 includes a panel 120, similar to the panel 62 above, being attached to and extending upwardly from a juncture of the card holder 110 and the container 12. The panel 120 has a distal edge 122 with respect to the card holder 110. The panel 120 has a first side edge 124, a second edge 126, an inner surface 128 and an outer surface 130. The inner surface 128 of the panel 120 is extendable rearwardly away from the card holder 110, over the container 12 when the container 12 is in the folded condition, and abutted against the front side 111 of the card holder 110. The panel 120 is removably attached to the front side 111 of the card holder 110 when the container 12 is in the folded condition to retain the container 12 in the folded condition and in abutment with the card holder 110. As with panel 62 above, the panel 120 herein may be attached with a first mating member 132 and a second mating member 134 and may include conventional releasable fastenings such as hook and loop fasteners, snaps, buttons, magnets and the like. The front side 111 of the card holder 110 faces away from the container 12 when the container 12 is in the folded condition.

The second embodiment 100 is used in a similar manner to the first embodiment described above. However, the smaller size of the card holder 110 versus the wallet 50 allows the second embodiment 100 to be as less material will be needed than is required by the wallet 50. This will also accommodate those persons who do not carry large amount of paper money or other items that may be stored within a wallet.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible satchel and card receiver combination assembly configured to be converted between a satchel configuration and a wallet configuration, the assembly comprising:

a container being flexible and including a perimeter wall having an upper end being open to access an interior of the container, the container being configured to be manipulated into a folded condition wherein the container is folded multiple times upon itself and into a deployed condition wherein the container is unfolded;

a card holder being attached to a front wall of the container such that an upper edge the card holder is positioned adjacent to the upper end and the first lateral edge of the container, the card holder being positionable in the container when the container is in the deployed condition, the card holder having a front side including plurality of card pockets each having a size configured to receive a credit card, the card holder having a width measurement taken along its upper edge being less than 4.0 inches, the card holder having length measured from its upper edge to a lower edge being less than 3.5 inches:

the container being abuttable against the card holder when the container is in the folded condition such that the container has a length and width substantially equal to the length and width of the container;

a closure releasably retaining the container in the folded condition and in abutment with the card holder such that at least one of the card pockets is exposed; and wherein the closure includes a panel being attached to and extending upwardly from a juncture of the card holder and the container, the panel having a distal edge with respect to the card holder, the panel having a first side edge, a second edge, an inner surface and an outer surface, the inner surface of the panel being extendable rearwardly away from the card holder, over the container when the container is in the folded condition, and abutted against the front side of the card holder, the panel being removably attached to the front side of the card holder when the container is in the folded condition to retain the container in the folded condition and in abutment with the card holder, the front side facing away from the container when the container is in the folded condition.

2. The collapsible satchel and card receiver combination assembly according to claim 1, the perimeter wall including a first lateral edge, a second lateral edge and a bottom edge, the perimeter wall including the front wall and having a rear wall, the front and rear walls being joined together along the first lateral edge, the second lateral edge and the bottom edge, the front and rear walls each having a rectangular shape.

3. The collapsible satchel and card receiver combination assembly according to claim 1, wherein the container is foldable along multiple horizontal fold lines extending from the first lateral edge to the second lateral edge to define horizontal sections of the perimeter wall each having a same height.

4. The collapsible satchel and card receiver combination assembly according to claim 3, wherein the container is foldable along a vertical fold line extending from the upper end to the bottom edge to define vertical sections each having a same width.

5. The collapsible satchel and card receiver combination assembly according to claim 1, further including a strap being attached to the container adjacent to the upper end, the strap having attached ends positioned within the container.

6. The collapsible satchel and card receiver combination assembly according to claim 1, further including a strap being attached to the container adjacent to the upper end, the strap having attached ends positioned within the container.

* * * * *